US009045988B2

(12) United States Patent
Mishra et al.

(10) Patent No.: US 9,045,988 B2
(45) Date of Patent: Jun. 2, 2015

(54) TURBINE BUCKET WITH SQUEALER TIP

(75) Inventors: Niraj Kumar Mishra, Bangalore (IN); Xiuzhang James Zhang, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 372 days.

(21) Appl. No.: 13/558,659

(22) Filed: Jul. 26, 2012

(65) Prior Publication Data

US 2014/0030101 A1 Jan. 30, 2014

(51) Int. Cl.
*F03B 3/12* (2006.01)
*F01D 5/20* (2006.01)

(52) U.S. Cl.
CPC ..... *F01D 5/20* (2013.01); *F05D 2260/201* (2013.01)

(58) Field of Classification Search
CPC ..... F01D 5/20; F01D 11/08; F01D 11/12; F05D 2240/307; F05D 2260/201; F05D 2260/202; F05D 2260/2214; F05D 2260/22141
USPC ..... 416/228, 236 A, 236 R, 235; 415/173.1, 415/173.3, 914
See application file for complete search history.

(56) References Cited

U.S. PATENT DOCUMENTS

| | | | | |
|---|---|---|---|---|
| 3,854,842 | A | 12/1974 | Caudill | |
| 4,390,320 | A * | 6/1983 | Eiswerth | 416/97 R |
| 5,733,102 | A | 3/1998 | Lee et al. | |
| 6,224,336 | B1 | 5/2001 | Kercher | |
| 6,224,337 | B1 | 5/2001 | Lieland et al. | |
| 6,478,537 | B2 * | 11/2002 | Junkin | 415/173.1 |
| 6,494,678 | B1 | 12/2002 | Bunker | |
| 6,672,829 | B1 | 1/2004 | Cherry et al. | |
| 7,281,894 | B2 | 10/2007 | Lee et al. | |
| 7,607,893 | B2 * | 10/2009 | Lee et al. | 416/228 |
| 7,686,578 | B2 | 3/2010 | Klasing et al. | |
| 7,704,045 | B1 | 4/2010 | Liang | |
| 2005/0068525 | A1 | 3/2005 | Taverner et al. | |
| 2009/0162200 | A1 * | 6/2009 | Tibbott et al. | 416/91 |
| 2010/0266410 | A1 | 10/2010 | Amarak et al. | |
| 2011/0135496 | A1 * | 6/2011 | Botrel et al. | 416/96 R |

* cited by examiner

*Primary Examiner* — Dwayne J White
*Assistant Examiner* — Alexander White
(74) *Attorney, Agent, or Firm* — Dority & Manning, P.A.

(57) ABSTRACT

A turbine bucket having an airfoil is disclosed. The airfoil may include a pressure side wall and a suction side wall extending between a leading edge and a trailing edge. In addition, the airfoil may include a base and a tip disposed opposite the base. The tip may include a tip floor and pressure and suction side tip walls extending outwardly from the tip floor. Moreover, the tip may include an intermediate tip wall extending outwardly from the tip floor between the pressure and suction side tip walls. The intermediate tip wall may define a height that is less than a height of the pressure and/or suction side tip walls.

20 Claims, 4 Drawing Sheets

FIG. —1—

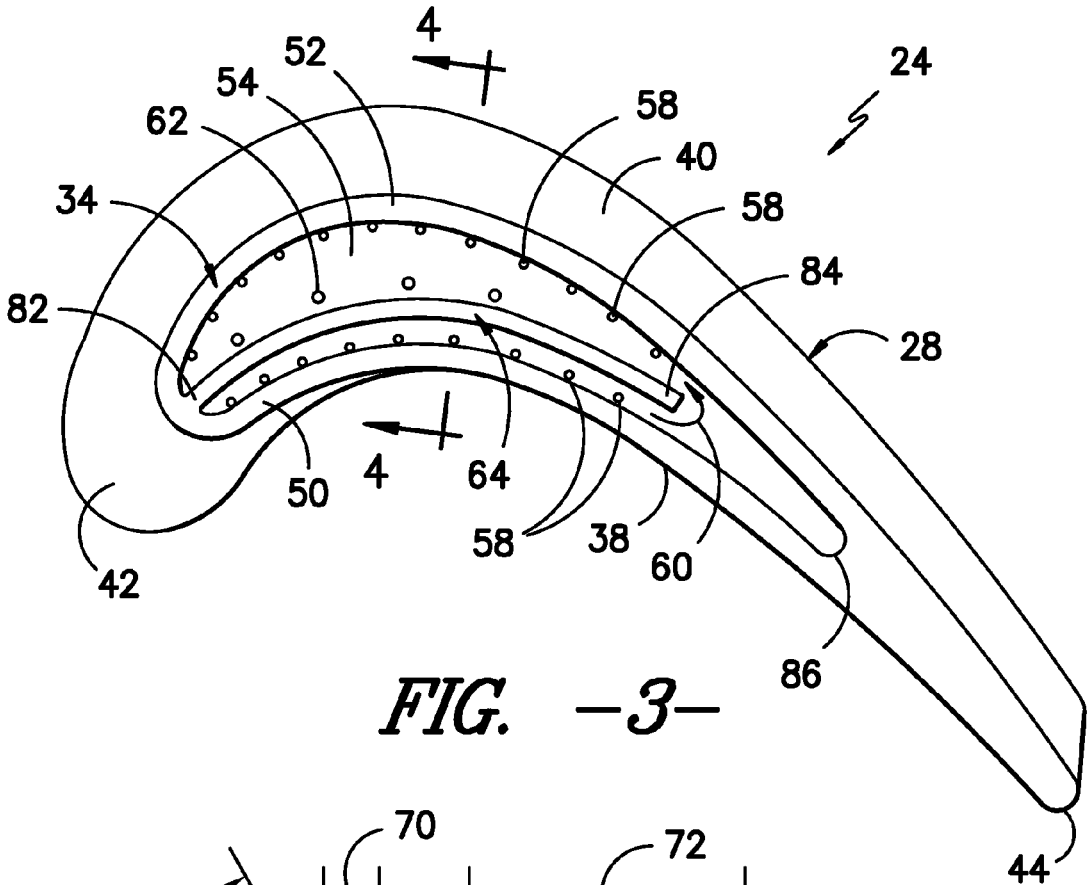
FIG. —3—
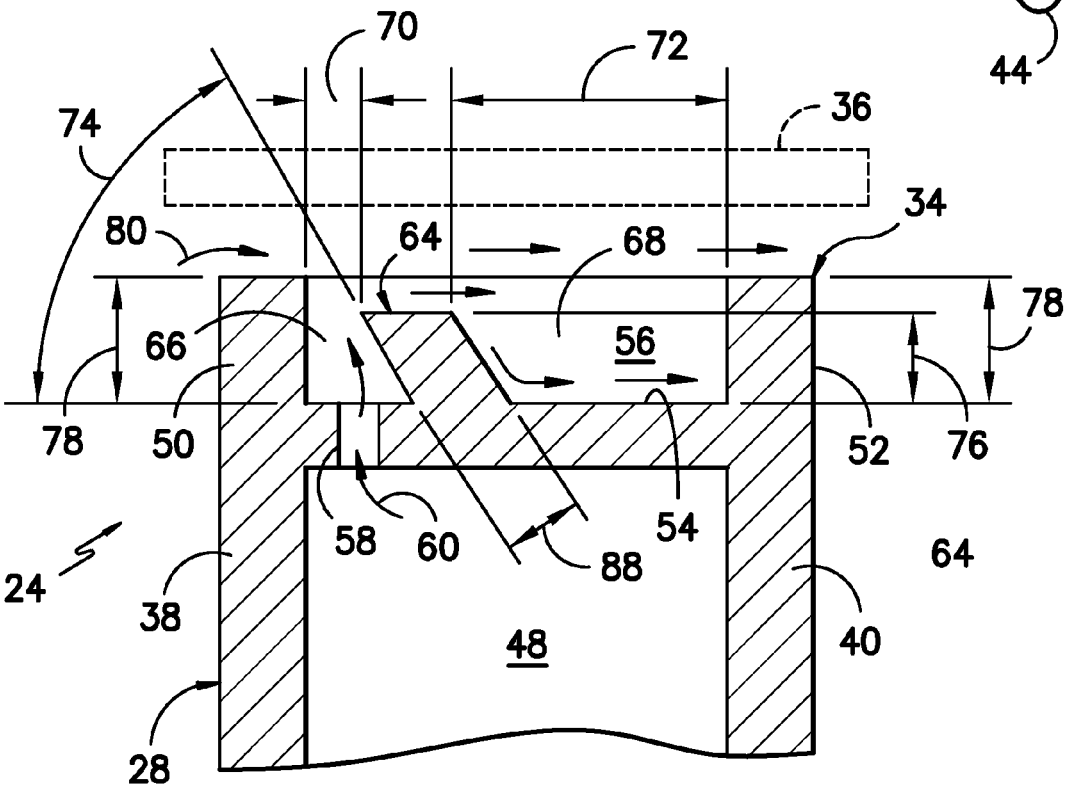
FIG. —4—

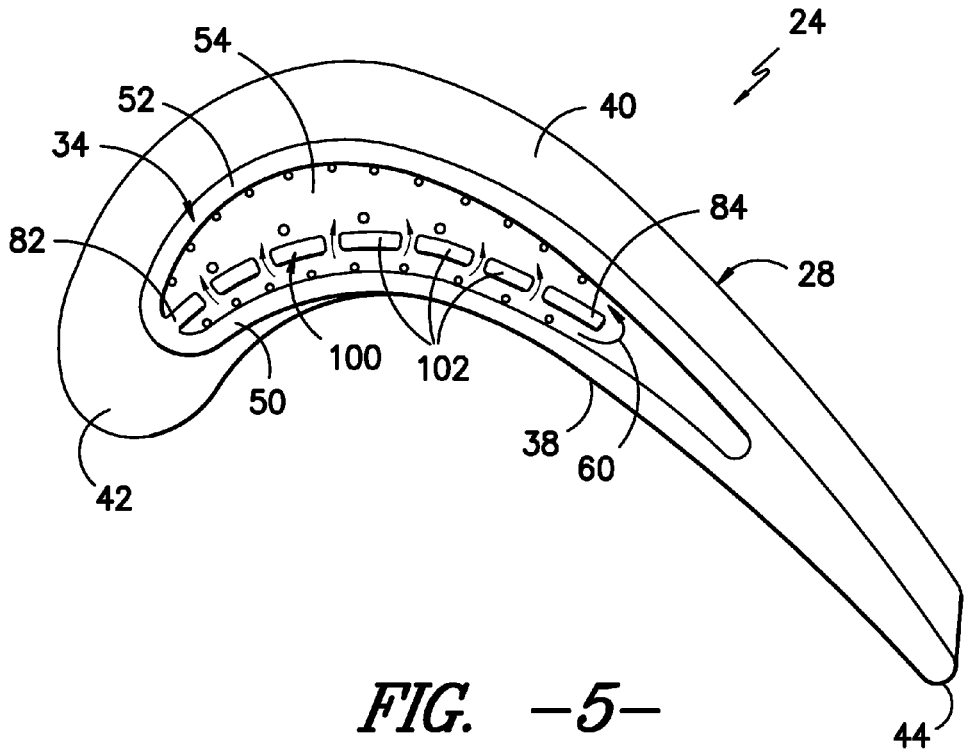
FIG. –5–

TURBINE BUCKET WITH SQUEALER TIP

FIELD OF THE INVENTION

The present subject matter relates generally to turbine buckets and, more particular, to an improved squealer tip for a turbine bucket that includes an intermediate wall dividing the squealer cavity.

BACKGROUND OF THE INVENTION

In an air-ingesting turbo machine (e.g., a gas turbine), air is pressurized by a compressor and then mixed with fuel and ignited within an annular array of combustors to generate hot gases of combustion. The hot gases flow from each combustor through a transition piece for flow along an annular hot gas path. Turbine stages are typically disposed along the hot gas path such that the hot gases flow through first-stage nozzles and buckets and through the nozzles and buckets of follow-on turbine stages. The turbine buckets may be secured to a plurality of rotor disks comprising the turbine rotor, with each rotor disk being mounted to the rotor shaft for rotation therewith.

A turbine bucket generally includes an airfoil extending radially outwardly from a substantially planar platform and a shank portion extending radially inwardly from the platform for securing the bucket to one of the rotor disks. The tip of the airfoil is typically configured to be spaced radially inwardly from a stationary shroud of the turbo machine such that a small gap is defined between the tip and the shroud. This gap is typically sized as small as practical to minimize the flow of hot gases between the airfoil tip and the shroud.

In many instances, the tip of the airfoil may include a squealer tip wall extending around the perimeter of the airfoil so as to define a tip cavity and a tip floor therebetween. The squealer tip wall is generally used to reduce the size of the gap defined between the airfoil tip and the shroud. However, this creates an additional component of the turbine bucket that is subject to heating by the hot gas flowing around the airfoil. Thus, cooling holes are typically defined in the tip floor to allow a cooling medium to be directed from an airfoil cooling circuit within the airfoil to the tip cavity.

Accordingly, an improved tip configuration that allows for enhanced cooling of an airfoil tip would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a turbine bucket including an airfoil. The airfoil may include a pressure side wall and a suction side wall extending between a leading edge and a trailing edge. In addition, the airfoil may include a base and a tip disposed opposite the base. The tip may include a tip floor and pressure and suction side tip walls extending outwardly from the tip floor. Moreover, the tip may include an intermediate tip wall extending outwardly from the tip floor between the pressure and suction side tip walls. The intermediate tip wall may define a height that is less than a height of the pressure and/or suction side tip walls.

In another aspect, the present subject matter is directed to a turbine bucket including an airfoil. The airfoil may include a pressure side wall and a suction side wall extending between a leading edge and a trailing edge. In addition, the airfoil may include a base and a tip disposed opposite the base. The tip may include a tip floor and pressure and suction side tip walls extending outwardly from the tip floor. Moreover, the tip may include an intermediate tip wall extending outwardly from the tip floor between the pressure and suction side tip walls at a non-perpendicular angle.

In a further aspect, the present subject matter is directed to a turbine bucket including an airfoil. The airfoil may include a pressure side wall and a suction side wall extending between a leading edge and a trailing edge. In addition, the airfoil may include a base and a tip disposed opposite the base. The tip may include a tip floor and pressure and suction side tip walls extending outwardly from the tip floor. Moreover, the tip may include an intermediate tip wall extending outwardly from the tip floor between the pressure and suction side tip walls. The intermediate tip wall may include a leading end disposed adjacent to the leading edge of the airfoil and a trailing end opposite the leading end. The trailing end of the intermediate tip wall may be spaced apart from the trailing edge of the airfoil such that a slot defined between the pressure side tip wall and the intermediate tip wall is open to a slot defined between the intermediate tip wall and the suction side tip wall at the trailing end.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 3 illustrates a top view of the turbine bucket shown in FIG. 2, particularly illustrating an airfoil tip of the turbine bucket;

FIG. 4 illustrates a cross-sectional view of the airfoil tip shown in FIG. 3 taken along line 4-4; and FIG. 5 illustrates a top view of another embodiment of a turbine bucket having an airfoil tip in accordance with aspects of the present subject matter.

DETAILED DESCRIPTION OF THE INVENTION

Figure 1:
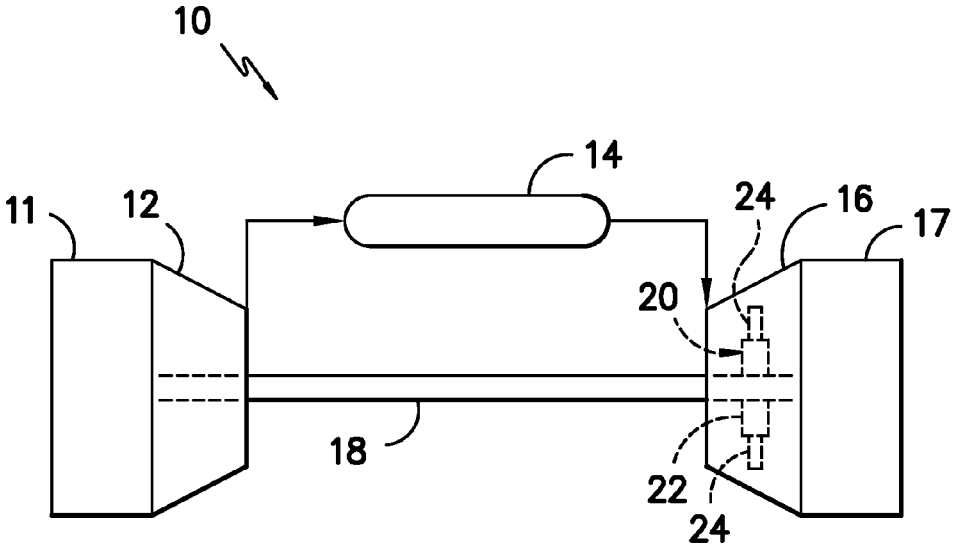
FIG. 1 illustrates a schematic diagram of one embodiment of a turbo machine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a turbine bucket having an improved squealer tip. Specifically, in several embodiments, the squealer tip may include pressure and suction side tip walls extending radially from a tip floor, thereby define a squealer cavity between the tip walls. The squealer tip may also include an intermediate tip wall extending from the tip floor between the pressure and suction side tip walls. In one embodiment, the intermediate tip wall may be configured to define a radial height that is less than a radial height of the pressure and suction side tip walls. In addition to such reduced height or as an alternative thereto, the intermediate tip wall may be angled towards the pressure side tip wall. Moreover, in one embodiment, the intermediate tip wall may be configured to extend partially between the leading and trailing edges of the airfoil.

By including the disclosed intermediate tip wall within a squealer tip, the ability to effectively cool the squealer tip may be significantly enhanced. For example, the disclosed intermediate tip wall may be configured to divert cooling air onto the pressure side tip wall, thereby providing increasing cooling to the hot side of the airfoil. In addition, the intermediate tip wall may also allow for hot gas recirculation within the squealer cavity to be reduced or eliminated.

Referring now to the drawings, FIG. 1 illustrates a schematic diagram of one embodiment of an air-ingesting turbo machine 10. The turbo machine 10 generally includes an inlet section 11, a compressor section 12 disposed downstream of the inlet section 11, a plurality of combustors (not shown) within a combustor section 14 disposed downstream of the compressor section 12, a turbine section 16 disposed downstream of the combustor section 14 and an exhaust section 17 disposed downstream of the turbine section 16. Additionally, the turbo machine 10 may include a shaft 18 coupled between the compressor section 12 and the turbine section 16. The turbine section 16 may generally include a turbine rotor 20 having a plurality of rotor disks 22 (one of which is shown) and a plurality of turbine buckets 24 extending radially outwardly from and being coupled to each rotor disk 22 for rotation therewith. Each rotor disk 22 may, in turn, be coupled to a portion of the shaft 18 extending through the turbine section 16.

During operation of the turbo machine 10, the compressor section 12 pressurizes air entering the machine 10 through the inlet section 11 and supplies the pressurized air to the combustors of the combustor section 14. The pressurized air is mixed with fuel and burned within each combustor to produce hot gases of combustion. The hot gases of combustion flow in a hot gas path from the combustor section 14 to the turbine section 16, wherein energy is extracted from the hot gases by the turbine buckets 24. The energy extracted by the turbine buckets 24 is used to rotate the rotor disks 22 which may, in turn, rotate the shaft 18. The mechanical rotational energy may then be used to power the compressor section 12 and generate electricity. The hot gases exiting the turbine section 16 may then be exhausted from the machine 10 via the exhaust section 17.

Figure 2:
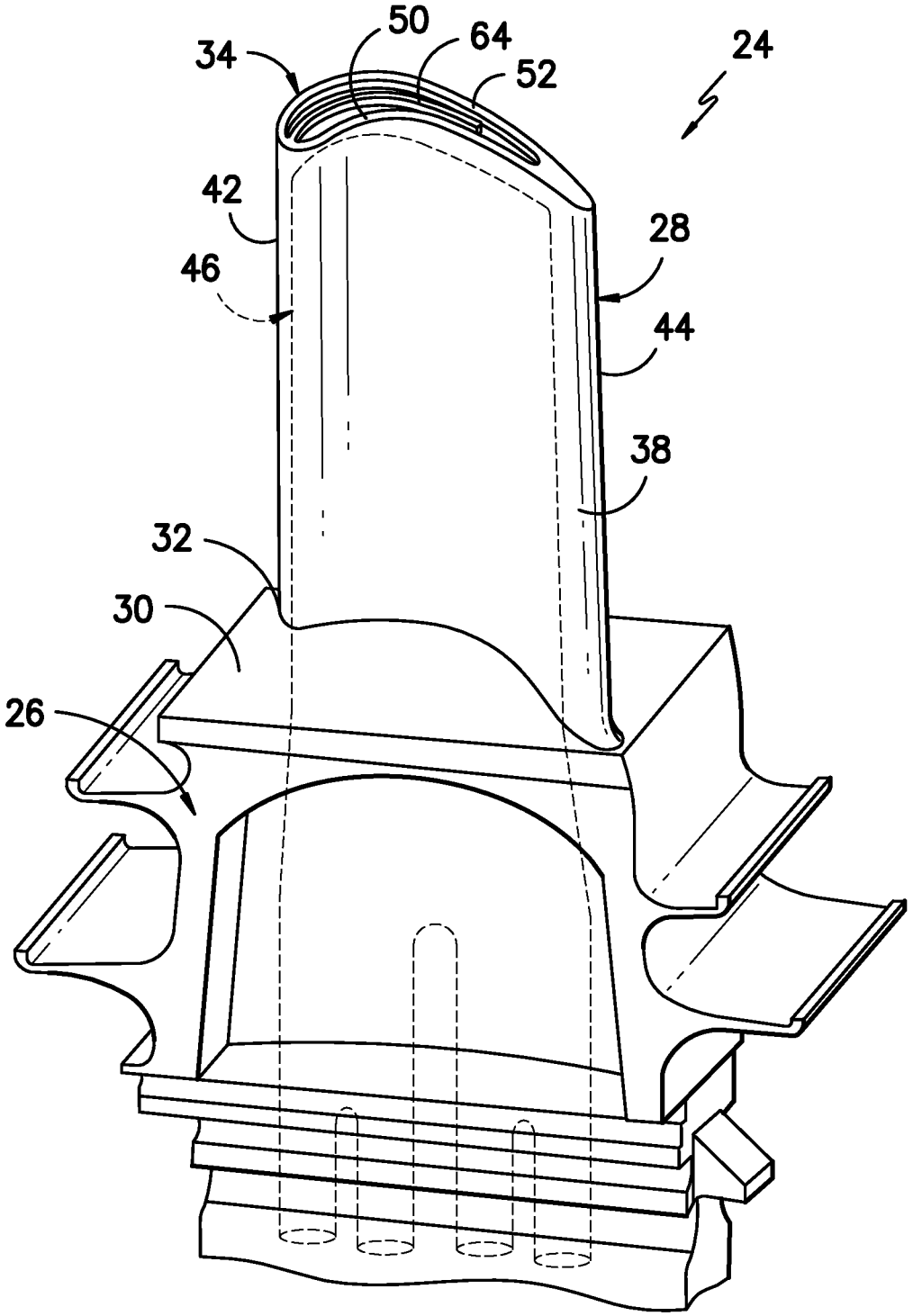
FIG. 2 illustrates a perspective view of one embodiment of a turbine bucket in accordance with aspects of the present subject matter.

Referring now to FIGS. 2-4, one embodiment of a turbine bucket 24 is illustrated in accordance with aspects of the present subject matter. In particular, FIG. 2 illustrates a perspective view of the turbine bucket 24. FIG. 3 illustrates a top view of the turbine bucket 24. Additionally, FIG. 4 illustrates a partial, cross-sectional view of the turbine bucket 24 taken along line 4-4 (FIG. 3).

As shown, the turbine bucket 24 generally includes a shank portion 26 and an airfoil 28 extending from a substantially planar platform 30. The platform 30 generally serves as the radially inward boundary for the hot gases of combustion flowing through the turbine section 16 of the turbo machine 10 (FIG. 1). The shank portion 26 may generally be configured to extend radially inwardly from the platform 30 and may include a root structure (not shown), such as a dovetail, configured to secure the bucket 24 to the rotor disk 22 of the turbo machine 10 (FIG. 1).

The airfoil 28 may generally extend radially outwardly from the platform 30 and may include an airfoil base 32 disposed at the platform 30 and an airfoil tip 34 disposed opposite the airfoil base 32. As such, the airfoil tip 34 may generally define the radially outermost portion of the turbine bucket 24 and, thus, may be configured to be positioned adjacent to a stationary shroud 36 (shown in dashed lines in FIG. 4) of the turbo machine 10. The airfoil 28 may also include a pressure side wall 38 and a suction side wall 40 (FIGS. 3 and 4) extending between a leading edge 42 and a trailing edge 44. The pressure side wall 38 may generally comprise an aerodynamic, concave outer wall of the airfoil 30. Similarly, the suction side wall 40 may generally define an aerodynamic, convex outer wall of the airfoil 30.

Additionally, the turbine bucket 24 may also include an airfoil cooling circuit 46 (shown in dashed lines in FIG. 2) extending radially outwardly from the shank portion 26 for flowing a cooling medium (e.g., air, water, steam or any other suitable fluid), throughout the airfoil 28. The airfoil circuit 46 may generally have any suitable configuration known in the art. Thus, in several embodiments, the airfoil circuit 46 may include a plurality of channels or passages 48 (one of which is shown in the cross-sectional view of FIG. 4) extending radially within the airfoil 28, such as from the airfoil base 32 to a location generally adjacent the airfoil tip 34. For example, in one embodiment, the airfoil circuit 46 may be configured as a multiple-pass cooling circuit, with the passages 48 being interconnected and extending radially inward and radially outward within the airfoil 28 (e.g., in a serpentine-like path) such that the cooling medium within the passages 48 flows alternately radially outwardly and radially inwardly throughout the airfoil 28.

Referring particularly to FIGS. 3 and 4, in several embodiments, the airfoil tip 34 may be configured as a squealer tip. As such, the airfoil tip 34 may include pressure and suction side tip walls 50, 52 extending radially outwardly from a tip floor 54, thereby defining a squealer tip cavity 56 (FIG. 4) between the tip walls 50, 52. As particularly shown in FIG. 4, the tip floor 54 may generally define a radially outer boundary for cooling passages 48 of the airfoil circuit 46. In addition, the tip floor 54 may define a plurality of cooling holes 58 for directing the cooling medium (indicated by arrows 60) flowing within the cooling passages 48 into the tip cavity 56. For instance, as shown in FIGS. 3 and 4, the cooling holes 58 may be spaced apart along the tip floor 54 at locations generally adjacent to the pressure and suction side tip walls 50, 52. As such, the cooling medium 60 flowing through the cooling holes 58 may be directed around the inner perimeter of the tip walls 50, 52 to provide impingement and/or film cooling to the airfoil tip 34.

It should be appreciated one or more dust holes 62 may also be defined through the tip floor 54 for expelling dust and/or other debris contained within the cooling medium supplied through the airfoil circuit 46. For example, as shown in FIG. 3, the dust holes 62 may be defined in the tip floor 54 at a generally central location between the pressure and suction side tip walls 50, 52 so as to align the dust holes 62 with the cooling passages 48 of the airfoil circuit 46. As such, any dust and/or debris carried within cooling medium may be expelled from the cooling passages 48 through the dust holes 54.

The pressure and suction side tip walls 50, 52 of the airfoil tip 34 may generally be configured to be aligned with and/or form extensions of the pressure and suction side walls 38, 40 of the airfoil 28. For example, as shown in FIG. 4, the pressure side tip wall 50 may be formed integrally with the pressure side wall 38 and, thus, may extend radially outwardly from the pressure side wall 38 at the tip floor 54. Similarly, the suction side tip wall 52 may be formed integrally with the suction side wall 40 and, thus, may extend radially outwardly from the suction side wall 40 at the tip floor 54. As such, the pressure and suction side tip walls 50, 52 may generally have the same or a similar configuration as the pressure and suction side walls 38, 40. For instance, the pressure side tip wall 50 may generally define a concave shape while the suction side tip wall 52 may generally define a convex shape. Additionally, as shown in FIG. 3, the pressure and suction side tip walls 50, 52 may extend lengthwise between the leading and trailing edges 42, 44 of the airfoil 28 so as to define a continuous wall around the perimeter of the airfoil 28.

Additionally, as shown in the illustrated embodiment, the airfoil tip 34 may also include an intermediate tip wall 64 extending outwardly from the tip floor 54 between the pressure and suction side tip walls 50, 52, thereby dividing the tip cavity 56 into two sections. Specifically, as shown in FIG. 4, the intermediate tip wall 63 may be spaced apart from the pressure side tip wall 50 such that a first slot 66 (FIG. 4) is defined between pressure side tip wall 50 and the intermediate tip wall 64. Similarly, the intermediate tip wall 64 may be spaced apart from the suction side tip wall 52 such that a second slot 68 (FIG. 4) is defined between the intermediate tip wall 64 and the suction side tip wall 52. In several embodiments, the intermediate tip wall 64 may be disposed closer to the pressure side tip wall 50 than the suction side tip wall 52. Thus, as shown in FIG. 4, a width 70 of the first slot 66 may be smaller than a width 72 of the second slot 68.

By positioning the intermediate tip wall 64 within the tip cavity 56 at a position relatively close to the pressure side tip wall 50, at least a portion of the cooling medium 60 directed through the cooling holes 58 may be used to cool the pressure side tip wall 50. For example, as shown in FIGS. 3 and 4, one or more of the cooling holes 58 may be defined in the tip floor 54 along the first slot 66. As such, the cooling medium 60 directed through such cooling holes 48 may be directed into the first slot 66, thereby providing beneficial cooling to the pressure side tip wall 50.

Additionally, in several embodiments, the intermediate tip wall 64 may be configured to extend outwardly from the tip floor 54 at a non-perpendicular angle 74. Specifically, as shown in FIG. 4, in one embodiment, the intermediate tip wall 64 may be angled outwardly from the tip floor 54 in the direction of the pressure side tip wall 64. As such, the cooling medium 60 directed into the first slot 66 may be diverted by the intermediate tip wall 64 towards the pressure side tip wall 50, thereby providing enhancing cooling for the pressure side tip wall 50. It should be appreciated that the angle 74 defined between the tip floor 54 and the intermediate tip wall 64 may generally comprise any suitable non-perpendicular angle. However, in a specific embodiment, the angle 74 may range from about 3 degrees to about 30 degrees, such as from about 3 degrees to about 10 degrees or from about 7 degrees to about 10 degrees and all other subranges therebetween. It should be appreciated that, in alternative embodiments, the intermediate tip wall 64 may be configured to extend perpendicularly from the tip floor 54 or at an angle towards the suction side tip wall 52.

It should also be appreciated that, in several embodiments, the cooling holes 58 aligned with the first slot 66 may be oriented perpendicularly or non-perpendicularly within the tip floor 54. For example, as shown in FIG. 4, the cooling holes 58 are defined perpendicularly within the tip floor 54 and, thus, extend generally parallel to the pressure side tip wall 50. However, in alternative embodiments, the cooling holes 58 may be angled relative to the pressure side tip wall 50. For instance, in one embodiment, the cooling holes 58 may be angled towards the pressure side tip wall 50 (e.g., at the same angle 74 as the intermediate tip wall 64) such that the cooling medium 60 supplied through the cooling holes 58 is directed against the inner surface of the pressure side tip wall 50.

Moreover, as shown in FIG. 4, the intermediate tip wall 64 may be configured to define a radial height 76 that is less than a radial height 78 of the pressure and/or suction side tip walls 50, 52. For example, in several embodiments, the radial height 76 of the intermediate tip wall 64 may range from about 30% to about 95% of the radial height 78 of the pressure and/or suction side tip walls 50, 52, such as from about 50% to about 95% of the radial height 78 or from about 60% to about 90% and all other subranges therebetween. By configuring the intermediate tip wall 64 to be shorter than the pressure and/or suction side tip walls 50, 52, the cooling medium 60 supplied into the first slot 66 may flow over the intermediate tip wall 54 without mixing with the flow of hot gasses (indicated by arrows 80) directed between the airfoil tip 34 and the shroud 36 of the turbo machine 10. As such, the cooling medium 60 may flow into the second slot 68 to provide beneficial cooling to the suction side tip wall 52. In addition, the cooling medium 60 may flowing over the intermediate tip wall 54 may help to reduce or prevent hot gas recirculation within the tip cavity 56.

It should be appreciated that, although the pressure and suction side tip walls 50, 52 are shown in FIG. 4 as having the same radial height 78, the pressure side tip wall 50 may define a radial height 78 that differs from the radial height of the 78 of the suction side tip wall 52. In such an embodiment, the intermediate tip wall 64 may be shorter that one or both of the pressure and suction side tip walls 50, 52.

Further, as shown in FIG. 3, the intermediate tip wall 64 may generally be configured to extend lengthwise between a leading end 82 and a trailing end 84. In several embodiments, the leading end 82 of the intermediate tip wall 64 may be disposed adjacent to the leading edge 42 of the airfoil 28. For example, as shown in FIG. 3, the leading end 82 may intersect and/or join the pressure and suction side tip walls 50, 52 at the leading edge 42 of the airfoil 28. Additionally, in several embodiments, the trailing end 84 of the intermediate tip wall 64 may be spaced apart from the trailing edge 44 of the airfoil 28. For instance, as shown in FIG. 3, the intermediate tip wall 64 may terminate within the tip cavity 56 such that the trailing end 84 is spaced apart from an intersection point 86 of the pressure and suction side tip walls 50, 52 defined adjacent to the trailing edge 44. As such, the first slot 66 may be open to (i.e., in flow communication with) the second slot 68, thereby allowing a portion of the cooling medium 60 supplied within the first slot 68 to flow around the trailing end 84 and into the second slot 68. Such open-ended slots 66, 68 may also allow for hot gas recirculation within the tip cavity 56 to be reduced and/or eliminated.

It should be appreciated that, in alternative embodiments, the leading end 82 of the intermediate tip wall 64 may be spaced apart from the leading edge 42 of the airfoil 28 or the intermediate tip wall 64 may be configured to extend entirely between the leading edge 42 of the airfoil 28 and the intersection point 85 of the pressure and suction side tip walls 50, 52.

Additionally, in several embodiments, the intermediate tip wall 64 may define a concave shape between its leading and trailing ends 82, 84 generally corresponding to the concave shape of the pressure side tip wall 50. For example, as shown in FIG. 4, in one embodiment, the intermediate tip wall 64 may be configured to extend generally parallel to the pressure side tip wall 50. As such, the width 70 of the first slot 66 may remain generally constant along the length of the intermediate tip wall 64. However, in other embodiments, the intermediate tip wall 64 may define any other suitable shape between its leading and trailing ends 82, 84.

Moreover, the intermediate tip wall 64 may also define a stream-wise width 88. It should be appreciated that the stream-wise width 88 may generally be any suitable width. For example, in one embodiment, the streamwise width 88 of the intermediate tip wall 100 may range from about 0.8 to about 1.3 times the streamwise width of the pressure side tip wall 50, such as from about 0.9 to about 1.2 times the streamwise width of the pressure side tip wall 50 and all other subranges therebetween. In addition, in several embodiments, the streamwise width 88 may be constant along the length of the intermediate tip wall 100 or may vary along the length of the intermediate tip wall 100. Similarly, it should be appreciated that, in one embodiment, the radial height 76 of the intermediate tip wall 64 may vary along the stream-wise width 88. For instance, the top surface of the intermediate tip wall 64 may angled.

Referring now to FIG. 5, a top view of another embodiment of an intermediate tip wall 100 that may be included within the airfoil tip 34 of a turbine bucket 24 is illustrated in accordance with aspects of the present subject matter. In general, intermediate tip wall 100 may be configured the same as the intermediate tip wall 64 described above and, thus, may include many and/or all of the same features and/or components (labeled with the same reference characters). However, as shown in FIG. 5, the intermediate tip wall 100 may be segmented between its leading and trailing ends 82, 84. Specifically, as shown, the intermediate tip wall 100 may be formed from a plurality of spaced apart wall segments 102 extending outwardly from the tip floor 54. As such, the cooling medium 60 supplied into the first slot 66 (FIG. 4) may be directed between the wall segments 102 and into the second slot 68 (FIG. 4).

It should be appreciated that, as an alternative to segmenting the intermediate tip wall 100, notches or channels may be defined in the intermediate tip wall 100 that extend from the top surface of the tip wall 100 to a location above the tip floor 54. As such, the cooling medium 60 supplied into the first slot 66 (FIG. 4) may be directed through the notches or channels and into the second slot 68 (FIG. 4) without segmenting the intermediate tip wall 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine bucket comprising:

an airfoil including a pressure side wall and a suction side wall extending between a leading edge and a trailing edge, the airfoil further including a base and a tip disposed opposite the base, the tip comprising:

a tip floor;

a pressure side tip wall extending outwardly from the tip floor;

a suction side tip wall extending outwardly from the tip floor; and an intermediate tip wall extending outwardly from the tip floor between the pressure and suction side tip walls, the intermediate tip wall defining a height that is less than a height of at least one of the pressure side tip wall or the suction side tip wall, wherein the intermediated tip wall extends lengthwise between a leading end and a trailing end, the intermediate tip wall being segmented between the leading and trailing ends.

2. The turbine bucket of claim 1, wherein the height of the intermediate tip wall ranges from about 30% to about 95% of the height of the at least one of the pressure side tip wall or the suction side tip wall.

3. The turbine bucket of claim 1, wherein the intermediate tip wall extends outwardly from the tip floor toward the pressure side tip wall at a non-perpendicular angle.

4. The turbine bucket of claim 3, wherein the non-perpendicular angle ranges from about 3 degrees to about 30 degrees.

5. The turbine bucket of claim 1, further comprising a plurality of cooling holes defined in the tip floor along a slot defined between the pressure side tip wall and the intermediate tip wall.

6. The turbine bucket of claim 5, wherein the plurality of cooling holes are oriented perpendicularly or non-perpendicularly within the tip floor.

7. The turbine bucket of claim 1, wherein a slot is defined between the pressure side tip wall and the intermediate tip wall, the intermediate tip wall extending generally parallel to the pressure side wall such that a width of the slot is generally constant.

8. The turbine bucket of claim 1, wherein the intermediate trailing end is spaced apart from the trailing edge of the airfoil such that a slot defined between the pressure side tip wall and the intermediate tip wall is open to a slot defined between the intermediate tip wall and the suction side tip wall at the trailing end.

9. A turbine bucket comprising:

an airfoil including a pressure side wall and a suction side wall extending between a leading edge and a trailing edge, the airfoil further including a base and a tip disposed opposite the base, the tip comprising:

a tip floor;

a pressure side tip wall extending outwardly from the tip floor;

a suction side tip wall extending outwardly from the tip floor; and an intermediate tip will extending outwardly from the tip floor between the pressure and suction side tip walls at a non-perpendicular angle, wherein the intermediate tip wall defines a height that is less than a height of at least one of the pressure side tip wall and the suction side tip wall.

10. The turbine bucket of claim 9, wherein the intermediate tip wall extends outwardly from the tip floor toward the pressure side tip wall at the non-perpendicular angle.

11. The turbine bucket of claim 9, wherein the non-perpendicular angle ranges from about 3 degrees to about 30 degrees.

12. The turbine bucket of claim 9, wherein the height of the intermediate tip wall ranges from about 30% to about 95% of the height of the at least one of the pressure side tip wall and the suction side tip wall.

13. The turbine bucket of claim 9, further comprising a plurality of cooling holes defined in the tip floor along a slot defined between the pressure side tip wall and the intermediate tip wall.

14. The turbine bucket of claim 13, wherein the plurality of cooling holes are oriented perpendicularly or non-perpendicularly within the tip floor.

15. The turbine bucket of claim 9, wherein a slot is defined between the pressure side tip wall and the intermediate tip wall, the intermediate tip wall extending generally parallel to the pressure side tip wall such that a width of the slot is generally constant.

16. The turbine bucket of claim 9, wherein the intermediate tip wall extends lengthwise between a leading end and a trailing end, the intermediate tip wall being segmented between the leading and trailing ends.

17. The turbine bucket of claim 9, wherein the intermediate tip wall extends between a leading end disposed adjacent to the leading edge of the airfoil and a trailing end disposed opposite the leading end, the trailing end being spaced apart from the trailing edge of the airfoil such that a slot defined between the pressure side tip wall and the intermediate tip wall is open to a slot defined between the intermediate tip wall and the suction side tip wall at the trailing end.

18. A turbine bucket comprising:

an airfoil including a pressure side wall and a suction side wall extending between a leading edge and a trailing edge, the airfoil further including a base and a tip disposed opposite the base, the tip comprising:

a tip floor;

a pressure side tip wall extending outwardly from the tip floor;

a suction side tip wall extending outwardly from the tip floor; and an intermediate tip wall extending outwardly from the tip floor between the pressure and suction side tip walls, the intermediate tip wall defining a height that is less than a height of at least one of the pressure side tip wall or the suction side tip wall, the intermediate tip wall extending between a leading end disposed adjacent to the leading edge of the airfoil and a trailing end disposed opposite the leading end, wherein the trailing end is spaced apart from the trailing edge of the airfoil such that a slot defined between the pressure side tip wall and the intermediate tip wall is open to a slot defined between the intermediate tip wall and the suction side tip wall at the trailing end.

19. The turbine bucket of claim 18, wherein the intermediate tip wall extends outwardly from the tip floor toward the pressure side tip wall at a non-perpendicular angle.

20. The turbine bucket of claim 18, wherein the intermediate tip wall is segmented between the leading and trailing ends.

* * * * *